United States Patent [19]

Müller et al.

[11] 4,151,698

[45] May 1, 1979

[54] APPARATUS FOR FILLING CUP-SHAPED CONTAINERS WITH PERISHABLE PRODUCTS

[75] Inventors: Hans P. Müller; Franz H. Bausch, both of Wuppertal, Fed. Rep. of Germany

[73] Assignee: Hamba-Maschinenfabrik Hans A. Müller GmbH & Co. KG, Wuppertal-Vohwinkel, Fed. Rep. of Germany

[21] Appl. No.: 830,336

[22] Filed: Sep. 2, 1977

[30] Foreign Application Priority Data

Oct. 12, 1976 [DE] Fed. Rep. of Germany ..... 2645904

[51] Int. Cl.[2] ..... B65B 3/04; B65B 61/26

[52] U.S. Cl. ..... 53/131; 53/240; 53/282

[58] Field of Search ..... 53/131, 133, 37, 237, 53/240, 250, 282, 184 R; 198/647, 656

[56] References Cited

U.S. PATENT DOCUMENTS

| | | | |
|---|---|---|---|
| 1,942,885 | 1/1934 | Tevander | 53/282 X |
| 2,663,130 | 12/1953 | Donofrio | 53/184 |
| 3,101,834 | 8/1963 | Meyer | 198/647 |
| 3,221,472 | 12/1965 | Groth et al. | 53/133 X |
| 3,328,937 | 7/1967 | Newman et al. | 53/282 |
| 3,354,614 | 11/1967 | St. Clair et al. | 53/282 |
| 3,456,424 | 7/1969 | Thurnston et al. | 53/240 |
| 3,654,746 | 4/1972 | Beckers | 53/282 X |
| 3,694,997 | 10/1972 | Christine et al. | 53/282 X |
| 4,024,694 | 5/1977 | Cooper et al. | 53/282 |

*Primary Examiner*—John Sipos

*Attorney, Agent, or Firm*—Montague & Ross

[57] ABSTRACT

An endless conveyor has equispaced sections provided with respective arrays of recesses designed to receive cup-shaped containers which are to be filled, covered by lids, sealed and date-stamped in respective stations past which the conveyor is intermittently advanced in steps equaling the width of a section. Each array consists of two parallel rows of recesses, transverse to the direction of conveyor motion, which are relatively staggered by half a pitch and have centerlines spaced apart by less than that pitch whereby the lids of containers seated in adjoining recesses overlap one another in both the longitudinal and the transverse direction. Each operating station coacts during each cycle with a leading and a trailing row of recesses, but not necessarily of the same array; thus, a dispensing station and a printing station consist each of two synchronized units respectively serving one row of an upstream section and a nonadjoining row of a downstream section. The lids applied to the cups by a capping station have tabs facing in diagonally opposite directions on the two rows of an array.

7 Claims, 3 Drawing Figures

APPARATUS FOR FILLING CUP-SHAPED CONTAINERS WITH PERISHABLE PRODUCTS

FIELD OF THE INVENTION

Our present invention relates to an apparatus for the automatic filling of cup-shaped containers with dairy products or other perishable substances.

BACKGROUND OF THE INVENTION

Machines are known which automatically fill such cups and carry out ancillary operations, including the covering and sealing of the containers, on a mass-production basis with the aid of a conveyor having seats in the form of recesses designed to receive the containers and to move them past a number of operating stations which are synchronized with the conveyor motion. These stations generally include a loading station depositing empty containers in the several recesses, a dispensing station introducing metered quantities of the product into each container moving past, a capping station supplying a lid to each filled container, and a sealing station for bonding the lid to the container. The operating speed of a metering dispenser is limited by mechanical as well as fluidic considerations. If the product to be dispensed is heavy cream or yogurt, for example, high supply velocities may lead to foaming and thereby to a wetting of the container rim interfering with the subsequent heat-sealing operation. The latter operation, with containers of thermoplastic resin, also requires a minimum cycle length in order to let the material of the container and its lid reach the necessary fusion temperature; attempts to accelerate this process by more intensive heating may result in an inadmissible deformation of the container mouth and/or a partial vaporization of the resin, preventing a hermetic closure. Thus, the common work cycle of the various synchronized operating stations cannot be significantly foreshortened with currently available techniques.

In order to increase the output rate of such an apparatus, therefore, it is the practice to let each station act concurrently upon a multiplicity of containers during every work cycle. For this purpose it is customary to arrange the container-receiving recesses of the conveyor in rows transverse to its direction of motion, each operating station serving all the recesses of a row aligned with it during a given work cycle. However, the length of each row and therefore the number of containers served in any cycle is also subject to physical restrictions. With a conveyor having 12 recesses per row and advancing by 30 steps per minute, for example, the theoretical output would be close to 22,000 containers per hour, yet in practice this rate of production is hardly ever achieved since the middle positions of a row are almost out of reach of the operating personnel so that the reloading of cup, lid and product feeders as well as adjustments such as the setting of terminal dates are difficult to perform in a central conveyor zone. In such a machine, therefore, an operator will frequently modify the existing equipment to leave the middle recesses of the several rows unoccupied.

OBJECT OF THE INVENTION

The object of our present invention, therefore, is to provide an improved apparatus of the type referred to whose output rate is substantially greater than that of generally similar machines of the prior art.

SUMMARY OF THE INVENTION

We realize this object, in conformity with our present invention, by longitudinally dividing the conveyor into a multiplicity of equispaced sections each provided with two rows of seats, i.e. a leading row and a trailing row, transverse to its direction of motion (referred to hereinafter as the x direction). With the conveyor intermittently advancing by steps equaling the spacing of homologous rows of adjacent sections, each operating section along the conveyor path coacts simultaneously during any work cycle, i.e. between consecutive conveyor steps, with a leading row and a trailing row of seats whereby the output rate is substantially double that of a conventional apparatus with a conveyor of the same width.

Advantageously, the two rows of an array are relatively staggered in the transverse or y direction by half a pitch, i.e. by half the center spacing of adjoining seats of a row. When the seats are circular recesses, as will generally be the case, such staggering allows the spacing of the centerlines of the two rows to be on the order of the diameter of a recess whereby the larger-diameter lids of a group of containers occupying the recesses of an array overlap one another in both the x and the y direction. Each of the two rows may have the same number of seats though one row could also have one seat more than the other.

Each operating station may serve the two rows of a single array or leading and trailing rows of different arrays during a given work cycle, depending on the physical layout of the station. Thus, a dispensing station designed to introduce a metered quantity of a product into any container aligned therewith usually requires more space than a loading station or a capping station supplying empty containers or lids therefore. Either of the latter stations, accordingly, can be built compact enough to serve a pair of adjoining rows, either on a single conveyor section or on two neighboring sections, during each cycle. The dispensing station, on the other hand, should have two parallel metering units so spaced apart in the x direction as to be simultaneously aligned, during each work cycle, with a leading row of seats of one conveyor section (e.g. an upstream section) and a trailing row of seats of another (e.g. downstream) conveyor section separated by one or more intervening sections. Similar considerations apply to date-stamping units of a printing station disposed downstream of the sealing station, except that there the rows served by the two units could lie at opposite edges of immediately adjoining sections.

Our invention, accordingly, affords a high degree of flexibility in the arrangement of the several operating stations with optimum utilization of the available space.

BRIEF DESCRIPTION OF THE DRAWING

The above and other features of our invention will now be described in detail with reference to the accompanying drawing in which.

SPECIFIC DESCRIPTION

Figure 1:
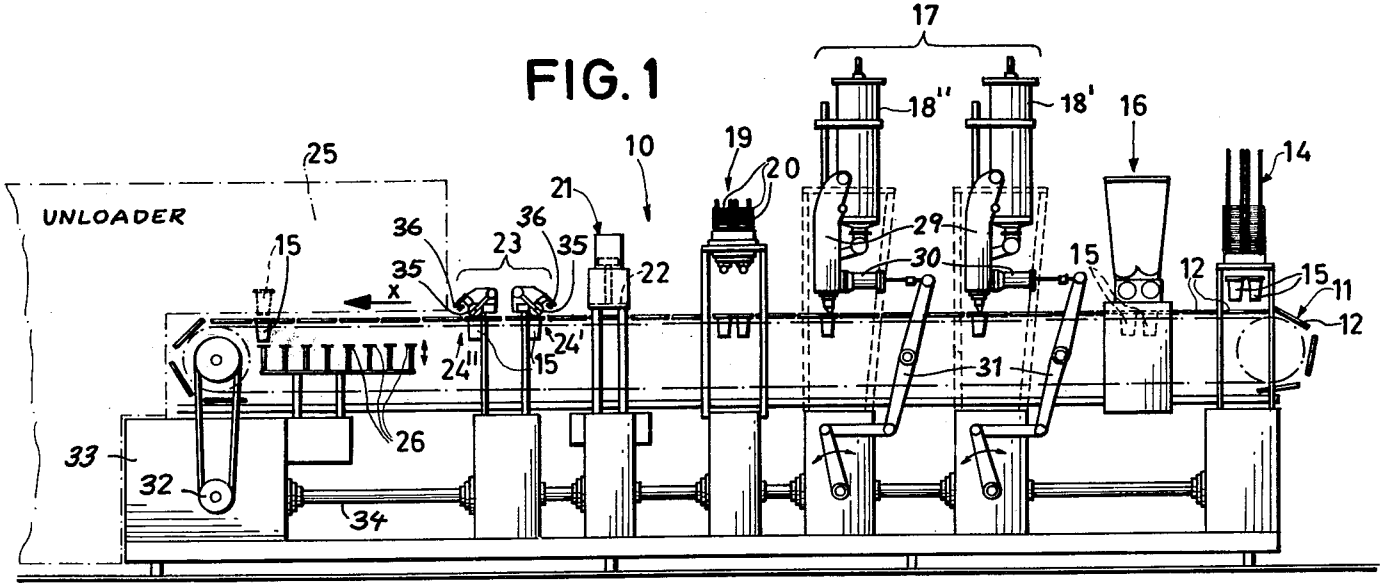
FIG. 1 is a side-elevational view of a container-filling apparatus according to our invention, including a conveyor and several operating stations.
Figure 2:
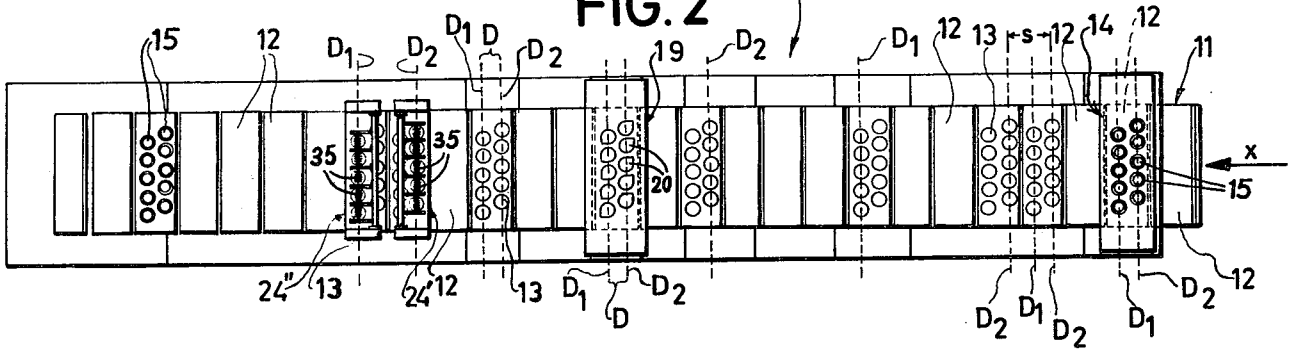
FIG. 2 is a diagrammatic plan view of the conveyor and other parts of the apparatus shown in FIG. 1.
Figure 3:
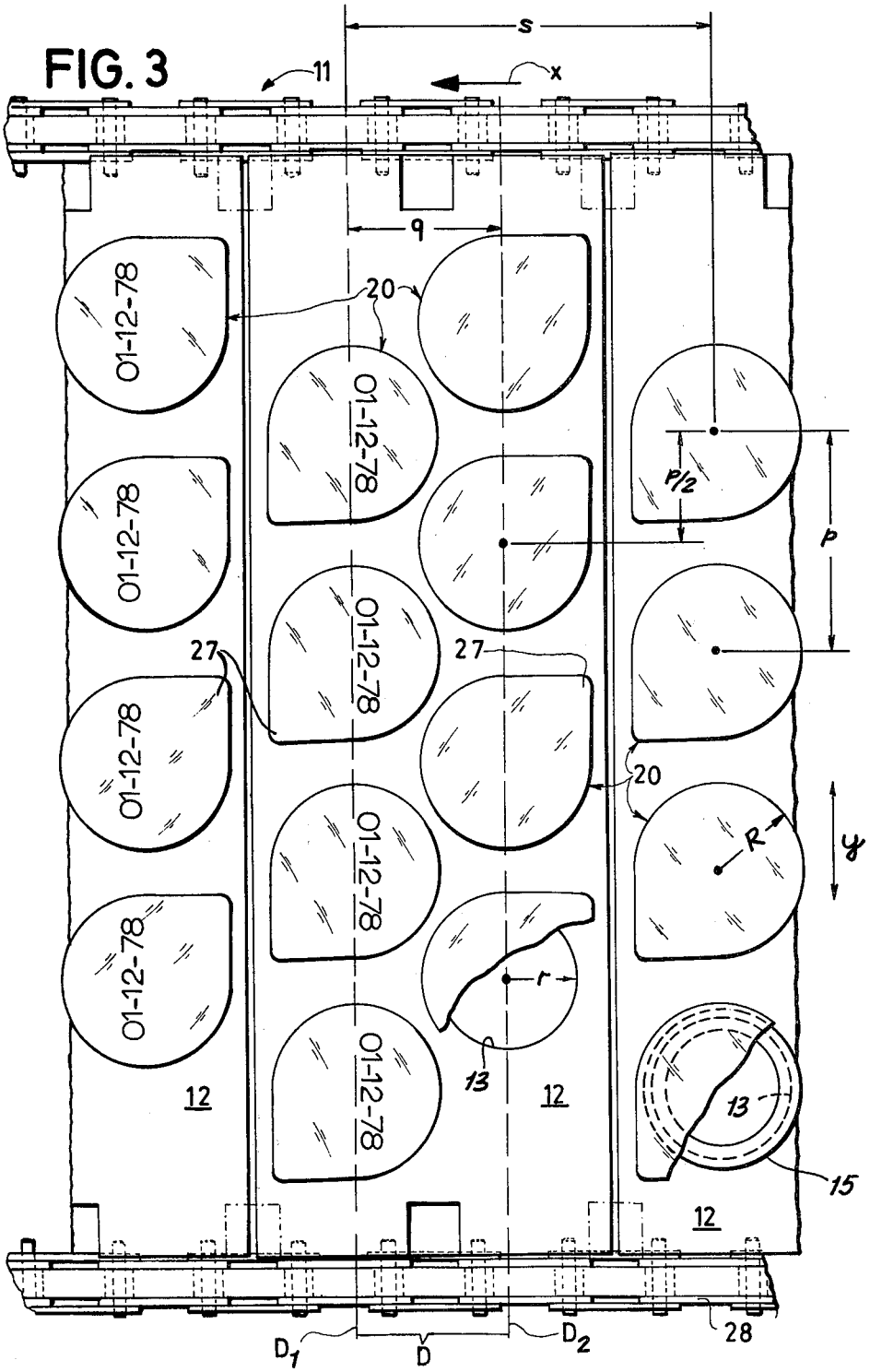
FIG. 3 is a fragmentary plan view of the conveyor of FIG. 2, drawn to a larger scale and showing a number of sealed and date-stamped containers carried thereon.

In FIGS. 1 and 2 we have shown an apparatus 10 comprising an endless conveyor 11 longitudinally divided into a multiplicity of sections 12 in the form of rectangular plates carried by a pair of lateral sprocket chains 28 (see FIG. 3). Each plate 12, extending with its major sides transversely to the direction x of conveyor motion, has an array of recesses 13 designed to receive individual cup-shaped containers 15 from respective hoppers of a loading station 14 disposed at the upstream end of the conveyor. The recesses 13 of each array are divided into two parallel rows collectively designated D, i.e. a leading row $D_1$ and a trailing row $D_2$, extending in the transverse direction y. In FIG. 2 we have shown five recesses 13 per row; in FIG. 3, for the sake of convenience, that number has been reduced to four. It will be understood, however, that each row could contain six or more recesses 13 if desired.

Conveyor 11 is intermittently advanced, via a transmission 32, by a driving unit 33 also linked by a shaft 34 with loading station 14 and other stations described hereinafter to synchronize their operation with the conveyor motion. In the interval between successive steps, accounting for a substantial fraction of a work cycle of about two seconds, each of these operating stations is aligned with a leading row $D_1$ and a trailing row $D_2$ of recesses 13, though not necessarily of the same array as will presently become clear. The length of a conveyor step equals the spacing s of homologous rows of adjoining sections 12.

The various operating stations of the apparatus 10 further include, downstream of loading station 14, a distributing or refilling station 16, a dispensing station 17, a capping station 19, a sealing station 21 and a printing station 23. Distributing station 16 has two rows of outlets respectively registering with the ten recesses 13 of a leading row $D_1$ of an upstream section 12 and of a trailing row $D_2$ of an immediately adjoining downstream section, the spacing of these two rows of adjecent sections being somewhat greater than that of the rows of a single array as will be apparent from FIG. 3. These outlets serve for the partial filling of the cups 15 inserted into the recesses aligned therewith, e.g. with a measured quantity of fruit syrup or preserves to be topped by a predetermined amount of yogurt. Thus, station 16 may comprise a vessel communicating with the several outlets via respective rotary valves that are opened by the shaft 34 for a brief period during each work cycle.

Dispensing station 17 comprises two metering units 18', 18" each including a chamber which opens via respective check valves into a row of five conduits 29 communicating with respective individual dosing cylinders 30, each of these cylinders containing a membrane piston driven by shaft 34 through a linkage 31 to discharge a predetermined amount of yogurt via another check valve into a respective cup 15. The outlets of the conduits 29 of the two units 18' and 18" are aligned, in each work cycle, with a leading row $D_1$ of an upstream conveyor section and a trailing row $D_2$ of a downstream conveyor section separated by three intervening sections (for the sake of simplicity, the recesses 13 of some of the conveyor sections 12 have been omitted in FIG. 2).

Capping station 19 has two sets of five hoppers each, similar to those of loading station 14, which carry stacks of lids 20 to be individually deposited upon the cups 15 of respective rows $D_1$ and $D_2$ of a single array during each work cycle.

Sealing station 21 includes a heated plate 22 which is vertically reciprocable to press upon the ten lids 20 of a group of cups 15 received in the recesses 13 of a single conveyor section 12 during any work cycle.

Printing station 23 comprises two date-stamping units 24', 24" which, during any work cycle, are aligned with a trailing row $D_2$ of an upstream section and a leading row $D_1$ of an immediately adjoining downstream section, each of these units comprising five sets of digit wheels 35 which swing past an associated ink pad 36 to print a terminal date upon the lids 20 of the respective cups. As illustrated in FIG. 3, these lids are of generally circular outline interrupted along one quadrant by a radially projecting tab 27 with a pair of orthogonal edges merging tangentially into the remainder of the circumference which extends over an arc of 270°. For space-saving purposes the lids are so placed in the hoppers of station 19 that the tabs 27 of adjacent cups in rows $D_1$ and $D_2$ point in diagonally opposite directions. In order that the terminal date of all containers may be read in the same way, as shown, stamping units 24' and 24" are relatively inverted; it should be noted that the two adjoining rows of neighboring sections 12 shown imprinted in FIG. 3 are not the ones simultaneously acted upon by units 24', 24".

At the downstream end of conveyor 11 there is provided a conventional unloading station 25 with ejector plates 26 which are periodically elevated by the driving unit 33 to lift the filled and sealed cups 15 of several oncoming conveyor sections 12 out of their recesses into the path of associated gripper arms, not shown, for transfer to a further destination. With four pairs of ejector plates, as shown, an unloading cycle lasts for four work cycles to facilitate the operation of the gripper arms.

As seen in FIG. 3, the vertical axes of the recesses 13 of adjoining rows $D_1$, $D_2$ are offset in the transverse direction y by half the pitch p of successive recesses of the same row. That offset p/2 is less than the recess diameter $2r$ and only slightly greater than the radius R of the circular portion of the lid periphery; the separation q of the centerlines of rows $D_1$ and $D_2$ in the direction x is on the order of $2r$ but less than 2R (and therefore also less than p) whereby the lids 20 overlap one another in the direction x as well as in the direction y. The edges of tabs 27 are parallel to these directions x and y and therefore also to one another. The spacing s of homologous rows is a little greater than $2q$.

At a convenient stepping rate of 33 cycles per minute, the number of cups inserted, filled, sealed, stamped and discharged with ten recesses per row is almost 20,000 per hour. That number can be easily increased by enlarging the arrays. The principles of our invention could, of course, be extended to arrays of more than two transverse rows of container seats, with corresponding modification of the associated operating stations to handle n·m containers per cycle where n is the number of seats per row and m is the number of rows per array.

We claim:

1. An apparatus for filling cup-shaped containers with a perishable substance, comprising:

an endless conveyor longitudinally divided into a multiplicity of equispaced interconnected sections, each of said sections being provided with an array of seats adapted to receive open-topped containers to be filled, the seats of each array forming a leading row and a trailing row transverse to the direction of conveyor motion;

drive means for intermittently advancing said conveyor by steps equaling the spacing of homologous rows of adjacent sections; and a plurality of operating stations disposed along the path of said conveyor and synchronized with said drive means for simultaneous coaction with a leading row and a trailing row of said seats during any work cycle between consecutive conveyor steps, said stations including a loading station for depositing empty containers in respective seats of a leading row and a trailing row during said work cycle, a dispensing station downstream of said loading station for filling said containers with said substances, a capping station downstream of said dispensing station for providing the filled containers of a leading row and a trailing row with respective lids during each work cycle, and a sealing station downstream of said capping station for hermetically bonding said lids onto said containers, said dispensing station including a pair of parallel metering units spaced apart in the direction of conveyor motion for simultaneous alignment during each work cycle with a leading row of one of said sections and a trailing row of another of said sections separated by at least one intervening section, said sealing station including a heated plate overlying in each work cycle the two rows of a single array of seats for engagement with their containers, said operating stations further including a distributing station between said loading station and said dispensing station for partly filling the containers of two adjacent rows of seats during each work cycle, said adjacent rows lying on different sections and being more widely separated from each other than the rows of a single array.

2. An apparatus as defined in claim 1 wherein said one of said sections lies upstream of said other of said sections.

3. An apparatus as defined in claim 1 wherein said stations further include a printing station downstream of said sealing station comprising a pair of parallel date-stamping units separated in the direction of conveyor motion for simultaneous alignment, during each work cycle, with a leading row of one of said sections and a trailing row of another of said sections, said date-stamping units being engageable with the lids of the containers in the recesses of the rows aligned therewith.

4. An apparatus as defined in claim 3 wherein said lids are noncircular with opposite-facing tabs on the rows of each array, said date-stemping units being relatively inverted for applying the stamped date to all lids in substantially the same position.

5. An apparatus as defined in claim 1 wherein said leading and trailing rows of each array are relatively staggered by half the pitch of said seats in a direction transverse to the direction of conveyor motion.

6. An apparatus as defined in claim 5 wherein the rows of each array have centerlines separated in the direction of conveyor motion by less than said pitch.

7. An apparatus as defined in claim 5 wherein each lid has a generally circular outline interrupted by a tab, said capping station comprising two sets of hoppers for depositing said lids onto the containers of a leading and a trailing row with their tabs pointing away from one another in diagonally opposite directions.

* * * * *